United States Patent [19]

Nishijima et al.

[11] Patent Number: 4,814,817

[45] Date of Patent: Mar. 21, 1989

[54] IMAGE FORMING DEVICE WITH SEPARABLE UNITS

[75] Inventors: Masaru Nishijima, Osaka; Toshio Yamagishi; Masanobu Deguchi, both of Nara, all of Japan

[73] Assignee: Sharp Kabushiki Kaisha, Osaka, Japan

[21] Appl. No.: 113,634

[22] Filed: Oct. 27, 1987

[30] Foreign Application Priority Data

Oct. 29, 1986 [JP] Japan ..... 61-257685

[51] Int. Cl.[4] ..... G03G 15/00

[52] U.S. Cl. ..... 355/3 R; 312/324

[58] Field of Search ..... 355/3 R, 3 DR, 354; 354/187, 288; 312/20, 298, 324

[56] References Cited

U.S. PATENT DOCUMENTS 4,681,422 7/1987 Oba et al. ..... 355/3 R 4,705,384 11/1987 Mizntani et al. ..... 355/3 R

FOREIGN PATENT DOCUMENTS 60-235166 11/1985 Japan ..... 355/3 R

*Primary Examiner*—A. T. Grimley
*Assistant Examiner*—J. Pendergrass
*Attorney, Agent, or Firm*—Flehr, Hohbach, Test, Albritton & Herbert

[57] ABSTRACT

An image forming device such as a copier has separate upper, middle and lower units which are mutually openable. The axes of rotation around which the upper unit can rotate with respect to the middle unit and the middle unit with respect to the lower unit are symmetrically disposed and engaging and locking mechanisms are provided such that when one of the pairs of mutually openable units is opened, the other pair is prevented from opening. Thus, the overall equalibrium of the device is not lost even if both pairs of units are opened.

8 Claims, 2 Drawing Sheets

IMAGE FORMING DEVICE WITH SEPARABLE UNITS

BACKGROUND OF THE INVENTION

This invention relates to an image forming device with separable units and more particularly to a mechanism by which an image forming device such as a copier is made separable into an upper unit, a middle unit and a lower unit.

Some image forming devices such as copiers are made separable into two or more units such that cleaning and other maintenance work inside the device can be carried out easily. An image recording device disclosed in Japanese Pat. No. 59-66247, for example, is comprised of an upper unit containing an optical system, a middle unit containing a photosensitive drum and a lower unit containing a portion of the passageway along which recording paper is transported such that the upper unit can be separated from the middle unit when the optical system is cleaned or other maintenance work is performed and the middle unit can be separated from the lower unit when a jammed sheet is removed or the passageway for paper is cleaned.

With a prior art device of this type, however, the upper unit may open up with respect to the middle unit, for example, while the user is removing a jammed sheet of paper after opening the middle unit with respect to the lower unit. In such a case, the balance of the device as a whole may be lost and the device may fall as a result.

SUMMARY OF THE INVENTION

It is therefore an object of the present invention to provide an image forming device which can be operated safely.

It is another object of the present invention to provide an image forming device with separable units which will not lose its balance or fall down easily when its units are opened.

An image forming device embodying the present invention which achieves the above and other objects comprises upper, middle and lower units which are separate and mutually openable. The axes of rotation around which the upper units can rotate with respect to the middle unit and the middle unit with respect to the lower unit are symmetrically disposed and engaging and locking mechanisms are provided such that when one of the pairs of mutually openable units is opened, the other pair is prevented from opening. This, the overall equilibrium of the device is not lost even if both pairs of units are opened.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
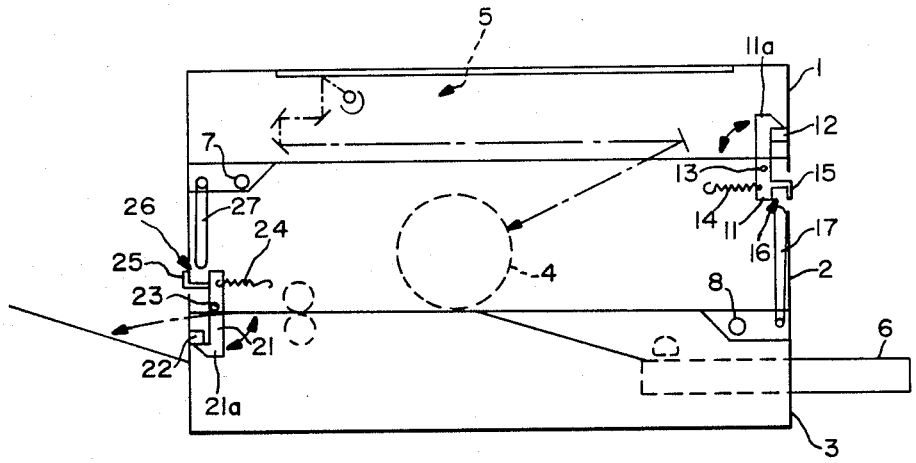
FIG. 1 is a schematic side sectional view of a copier separable into upper, middle and lower units and incorporating a mechanism embodying the present invention for opening and closing them.

A copier embodying the present invention shown in FIG. 1 is comprised of an upper unit 1, a middle unit 2 and a lower unit 3. The middle unit 2 contains a photosensitive drum 4 having a photoconductive layer as well as peripheral devices (not shown) for forming an image. The upper unit 1 contains an optical unit 5 for directing a beam of light to the photosensitive drum 4 and the lower unit 3 contains a paper cassette 6 as well as a portion of the path along which paper is transported. An axis of rotation 7 (also generally referred to as axis means) is disposed between the upper unit 1 and the middle unit 2 near the left-hand edge such that the upper unit 1 can open with respect to the middle unit 2. Similarly, another axis of rotation 8 is disposed between the middle unit 2 and the lower unit 3 near the right-hand edge symmetrically opposite to the first axis of rotation 7 such that the middle unit 2 can open with respect to the lower unit 3.

Near the right-hand edge inside near the upper unit 1 and the middle unit 2 is an engaging mechanism comprised of a hook piece 11 and a latch piece 12. The hook piece 11 is rotatably supported by the middle unit 2 around an axis 13 and a hook **11*a* is formed at its top end. The latch piece 12 is attached to the upper unit 1 such that the hook 11*a* can be engaged with the latch piece 12 if the hook piece 11 is rotated in the clockwise direction when the upper unit 1 is closed with respect to the middle unit 2 and disengaged from the latch piece 12 if the hook piece 11 is rotated in the counter-clockwise direction. A spring 14 is attached to the hook piece 11 so as to apply a biasing force thereonto in the clockwise direction. An L-shaped handle 15 is unistructurally formed on the hook piece 11 near its lower end such that a U-shaped concave engaging section 16 is formed by the handle 15 and the lower end of the hook piece 11. The handle 15 is adapted to stick out of the housing of the copier such that the user can pull this handle 15 to rotate the hook piece 11 in the counter-clockwise direction against the biasing force of the spring 14. A locking member 17 in the shape of a bar is disposed below the hook piece 11 with one end supported rotatably by the lower unit 3 near its upper right-hand edge. This locking member 17 can be rotated freely toward the interior of the housing but it can hardly move in the other direction because its motion is limited by the housing wall. The other end of the locking member 17 can engage with the aforementioned U-shaped engaging section 16 when the middle unit 2 moves down and closes with respect to the lower unit 3**.

The middle unit 2 and the lower unit 3 are joined in the same manner by means of another engaging mechanism including a hooking member 21 supported rotatably by the middle unit 2 at its left-hand edge, a latch piece 22 at the left-hand edge of the lower unit 3 and a locking member 27 at the lower left-hand edge of the upper unit 1. Other components of this engaging mechanism are similarly disposed and connected as explained in connection with the other engaging mechanism on the right-hand side of the copier. They are indicated by numerals greater by 10 than those indicating the corresponding components 11–17 and do not require separate explanations.

Figure 2A:
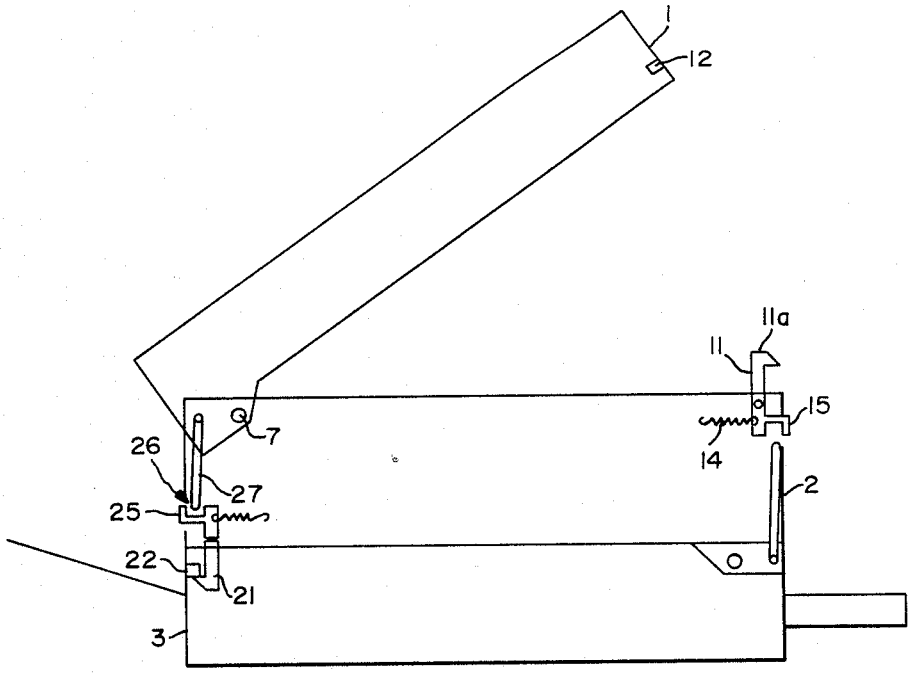
FIG. 2A is a schematic side view of the upper and middle units of the copier of FIG. 1 when they are open with respect to each other.

When the upper unit 1 is opened from the middle unit 2 as shown in FIG. 2A, the handle 15 is pulled outward to rotate the hook piece 11 in the counter-clockwise direction and to thereby release the engaged relationship between the hook 11*a* and the latch piece 12. If the right-hand edge of the upper unit 1 is pushed up thereafter, the upper unit 1 rotates around the axis of rotation 7 and its left-hand edge further to the left of this axis of rotation 7 moves down. This downward motion of the left-hand edge of the upper unit 1 causes the locking member 27, of which one end is attached to the left-hand edge of the upper unit 1, to move down such that its other end engages the corresponding concave engaging section 26. Since the outward motion of the locking member 27 is limited by the housing wall of the copier, its engagement with the engaging section 26 prevents the handle 25 from being pulled out. In other words, the engaged relationship between the hook piece 21 and the latch piece 22 cannot be released and hence the middle unit 2 cannot be opened from the lower unit 3 when the upper unit 1 is open with respect to the middle unit 2 When it is desired to close the upper unit 1, it has only to be pushed down such that the hook 11*a* at the upper end of the hook piece 11 slides against the latch piece 12 and engages therewith by the biasing force of the spring 14.

Figure 2B:
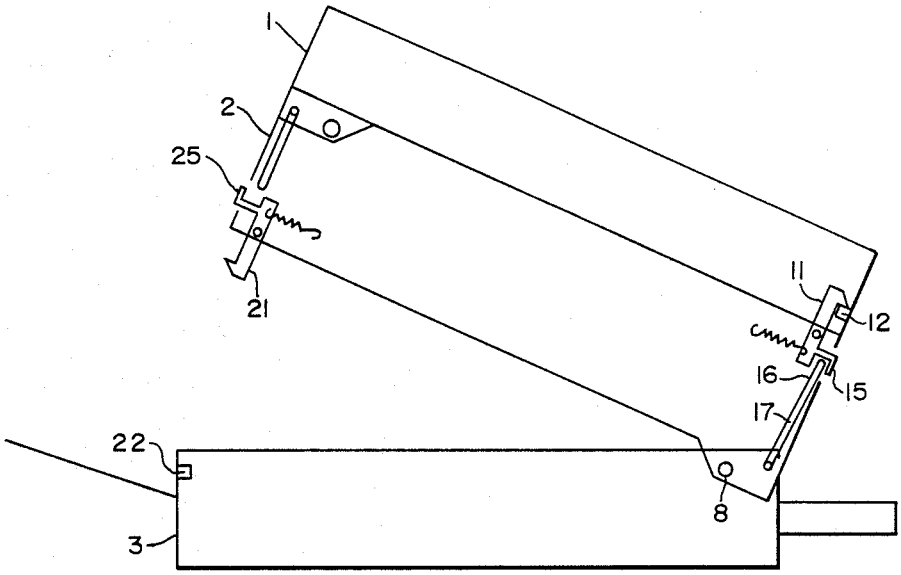
FIG. 2B is a schematic side view of the middle and lower units of the copier of FIG. 1 when they are open with respect to each other.

When the middle unit 2 is opened from the lower unit 3 with the upper unit remaining closed with respect to the middle unit 2 as shown in FIG. 2B, the engaged relationship between the hook piece 11 and the latch piece 12 cannot be released because the locking member 17 slides into the engaging section 26 and the handle 15 cannot be pulled out. In other words, the upper unit 1 cannot open from the middle unit 2 when the middle unit 2 is open with respect to the lower unit 3.

Moreover, since the two engaging mechanisms are symmetrically disposed with one at the left-hand edge and the other at the right-hand edge, the overall balance of the copier will not be lost even if both engaging mechanisms become disengaged. In other words, even if the user pulls the handle 15 before the locking member 17 engages with the engaging section 16 when the middle unit 2 is opened from the lower unit 3, the copier will not lose its equilibrium and will not fall down.

In summary, mechanisms are so provided to two pairs of mutually openable units that if one of the pairs of such units is opened, the engaged relationship between the other pair becomes unreleaseable. Even if both pairs of units are opened, furthermore, the overall balance is not lost because the two axes of rotation are symmetrically disposed.

The foregoing description of a preferred embodiment of the invention has been presented for purposes of illustration and description. It is not intended to be exhaustive or to limit the invention to the precise form disclosed, and many modifications and variations are possible in light of the above teaching. In particular, many known types of engaging mechanisms and locking devices may be substituted. Any such modifications and variations that may be apparent to a person skilled in the art are intended to be included within the scope of this invention.

What is claimed is:

1. In an image forming device comprising an upper unit, a middle unit which is joined with said upper unit rotatably around a first axis means and a lower unit which is joined with said middle unit rotatably around a second axis means whereby said upper unit and said middle unit form a first mutually openable pair and said middle unit and said lower unit form a second mutually openable pair, the improvement wherein said first and second axis means are symmetrically disposed, wherein each of said pairs is provided with an engaging mechanism for the corresponding one of said pairs, and wherein said device further comprises locking means for locking one of said engaging mechanisms when the pair corresponding to the other of said engaging mechanisms is open.

2. The device of claim 1 wherein said first and second axis means are parallel to each other.

3. The device of claim 1 wherein said engaging means includes a first piece which is rotatably supported by one of said units and has a hook at one end thereof and a second piece attached to another of said units, said first piece being engagable with said second piece.

4. The device of claim 3 wherein said first piece has a manually operable handle attached thereonto for disengaging said first piece from said second piece.

5. The device of claim 3 wherein said first piece is elongated and is rotatably attached to said middle unit.

6. The device of claim 1 wherein said locking means are each elongated and attached at one end thereof to said upper unit or to said lower unit.

7. The device of claim 4 wherein said locking means are elongated and one thereof is attached to said upper unit and is so connected and disposed as to move with respect to one of said engaging mechanisms corresponding to said second pair and to prevent said second pair from opening when said first pair is opened.

8. The device of claim 4 wherein said locking means are elongated and one thereof is attached to said lower unit and is so connected and disposed as to move with respect to one of said engaging mechanisms corresponding to said first pair and to prevent said first pair from opening when said second pair is opened.

* * * * *